US010453384B2

(12) United States Patent
Zhang

(10) Patent No.: US 10,453,384 B2
(45) Date of Patent: Oct. 22, 2019

(54) LUMINANCE COMPENSATION METHOD OF DISPLAY DEVICE, LUMINANCE COMPENSATION DEVICE AND DISPLAY DEVICE

(71) Applicant: BOE TECHNOLOGY GROUP CO., LTD., Beijing (CN)

(72) Inventor: Xiangfei Zhang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 14/436,967

(22) PCT Filed: Oct. 15, 2014

(86) PCT No.: PCT/CN2014/088689
§ 371 (c)(1),
(2) Date: Apr. 20, 2015

(87) PCT Pub. No.: WO2015/180374
PCT Pub. Date: Dec. 3, 2015

(65) Prior Publication Data

US 2015/0379922 A1 Dec. 31, 2015

(30) Foreign Application Priority Data

May 30, 2014 (CN) ..... 2014 1 0240582

(51) Int. Cl.
*G09G 3/32* (2016.01)
*G09G 3/3208* (2016.01)

(52) U.S. Cl.
CPC ... *G09G 3/3208* (2013.01); *G09G 2300/0842* (2013.01); *G09G 2300/0866* (2013.01);
(Continued)

(58) Field of Classification Search
CPC ..... G09G 3/3208; G09G 2300/0842; G09G 2300/0866; G09G 2310/066;
(Continued)

(56) References Cited

U.S. PATENT DOCUMENTS 5,517,333 A 5/1996 Tamura et al.
6,040,860 A 3/2000 Tamura et al.
(Continued)

FOREIGN PATENT DOCUMENTS

CN 1435810 A 8/2003
CN 1517960 A 8/2004
(Continued)

OTHER PUBLICATIONS

Feb. 19, 2015 (WO) International Search Report and Written Opinion PCT/CN2014/088689.
(Continued)

*Primary Examiner* — Temesghen Ghebretinsae
(74) *Attorney, Agent, or Firm* — Banner & Witcoff, Ltd.

(57) ABSTRACT

A luminance compensation method of a display device, a luminance compensation device and a display device are provided. The luminance compensation method of the display device, comprises: acquiring a preset first luminance compensation information list of the display device, the first luminance compensation information list comprising initial luminance compensation information of a part of a plurality of pixels of the display device; regenerating target luminance compensation information of all of the plurality of pixels of the display device according to the first luminance compensation information list; performing luminance compensation for an input image according to the target luminance compensation information of all of the plurality of
(Continued)

pixels of the display device, wherein the part of the plurality of pixels are dispersedly taken from all of the plurality of pixels of the display device.

11 Claims, 4 Drawing Sheets

(52) U.S. Cl.
CPC ..... *G09G 2310/066* (2013.01); *G09G 2320/0233* (2013.01); *G09G 2320/0261* (2013.01); *G09G 2320/043* (2013.01); *G09G 2320/045* (2013.01); *G09G 2320/0626* (2013.01); *G09G 2360/14* (2013.01); *G09G 2360/141* (2013.01); *G09G 2360/145* (2013.01); *G09G 2360/147* (2013.01)

(58) Field of Classification Search
CPC ... G09G 2320/0261; G09G 2320/0626; G09G 2360/147; G09G 2320/043; G09G 2320/045; G09G 2360/14; G09G 2360/141; G09G 2360/145; G09G 2320/0233
See application file for complete search history.

(56) References Cited

U.S. PATENT DOCUMENTS

| | | | | |
|---|---|---|---|---|
| 6,591,015 | B1 | 7/2003 | Yasunari et al. | |
| 8,014,623 | B2 | 9/2011 | Xie | |
| 8,497,827 | B2 | 7/2013 | Lee | |
| 2004/0080631 | A1 | 4/2004 | Tominaga et al. | |
| 2005/0226526 | A1 | 10/2005 | Mitsunaga | |
| 2006/0214940 | A1 | 9/2006 | Kinoshita et al. | |
| 2007/0229863 | A1 | 10/2007 | Ono et al. | |
| 2008/0284794 | A1 | 11/2008 | Wang et al. | |
| 2008/0303754 | A1* | 12/2008 | Murata | G09G 3/3233 345/76 |
| 2008/0304760 | A1 | 12/2008 | Lee et al. | |
| 2009/0058772 | A1* | 3/2009 | Lee | G09G 3/3233 345/82 |
| 2011/0023464 | A1 | 2/2011 | Lee et al. | |
| 2011/0115829 | A1 | 5/2011 | Ito et al. | |
| 2011/0181500 | A1 | 7/2011 | Liao | |
| 2012/0154460 | A1 | 6/2012 | Segawa et al. | |
| 2012/0176397 | A1 | 7/2012 | Mizukoshi et al. | |
| 2013/0027383 | A1 | 1/2013 | Odawara et al. | |
| 2014/0071189 | A1* | 3/2014 | Park | G09G 5/02 345/694 |
| 2014/0152721 | A1 | 6/2014 | Byun et al. | |
| 2014/0320042 | A1 | 10/2014 | Yamamoto et al. | |
| 2015/0264324 | A1* | 9/2015 | Sugawara | H04N 5/3696 348/302 |
| 2015/0269895 | A1 | 9/2015 | Kao et al. | |
| 2015/0325170 | A1 | 11/2015 | Jeon et al. | |
| 2016/0027354 | A1 | 1/2016 | Terai et al. | |

FOREIGN PATENT DOCUMENTS

| | | | |
|---|---|---|---|
| CN | 101640038 | A | 2/2010 |
| CN | 101667418 | A | 3/2010 |
| CN | 101996618 | A | 3/2011 |
| CN | 102025952 | A | 4/2011 |
| CN | 102231016 | A | 11/2011 |
| CN | 102347015 | A | 2/2012 |
| CN | 103489405 | A | 1/2014 |
| CN | 103531175 | A | 1/2014 |
| CN | 103792704 | A | 5/2014 |
| CN | 104021761 | A | 9/2014 |
| EP | 01424672 | A1 | 6/2004 |
| WO | 2009002316 | A1 | 12/2008 |

OTHER PUBLICATIONS

Oct. 8, 2015—(CN) First Office Action—App 201410240582.0.
Oct. 8, 2015—(CN) First Office Action—App 201410240582.0—English translation.
Dec. 28, 2016—U.S. First Non-final Office Action U.S. Appl. No. 14/437,169.
Apr. 2, 2015—(WO) ISR & WO—App. No. PCT/CN14/087599.
Apr. 2, 2015—(WO) ISR & WO—App. No. PCT/CN14/087599 English Translation.
Nov. 2, 2017—(EP) Extended European Search Report Appn 14851432.6.
Nov. 13, 2017—(EP) Extended European Search Report for application EP 14853155.1.
Jan. 8, 2015—(CN) Office Action application 201410240470.5 with English Translation.
Dec. 5, 2017—U.S. Notice of Allowance—U.S. Appl. No. 14/437,169.
Mar. 27, 2018—U.S. Notice of Allowance U.S. Appl. No. 14/437,169.

* cited by examiner

| | | | | | | | | | | | | | | |
|---|---|---|---|---|---|---|---|---|---|---|---|---|---|---|
| R | G | B | R | G | B | R | G | B | R | G | B | R | G | B |
| R | G | B | R | G | B | R | G | B | R | G | B | R | G | B |
| R | G | B | R | G | B | R | G | B | R | G | B | R | G | B |
| R | G | B | R | G | B | R | G | B | R | G | B | R | G | B |
| R | G | B | R | G | B | R | G | B | R | G | B | R | G | B |

FIG. 3

| | | | | | | | | | | | | |
|---|---|---|---|---|---|---|---|---|---|---|---|---|
| $R_{i,j}$ | $G_{i,j}$ | $B_{i,j}$ | $R_{i,j+1}$ | $G_{i,j+1}$ | $B_{i,j+1}$ | $R_{i,j+2}$ | $G_{i,j+2}$ | $B_{i,j+2}$ | $R_{i,j+3}$ | $G_{i,j+3}$ | $B_{i,j+3}$ | ··· |
| $R_{i+1,j}$ | $G_{i+1,j}$ | $B_{i+1,j}$ | $R_{i+1,j+1}$ | $G_{i+1,j+1}$ | $B_{i+1,j+1}$ | $R_{i+1,j+2}$ | $G_{i+1,j+2}$ | $B_{i+1,j+2}$ | $R_{i+1,j+3}$ | $G_{i+1,j+3}$ | $B_{i+1,j+3}$ | ··· |
| $R_{i+2,j}$ | $G_{i+2,j}$ | $B_{i+2,j}$ | $R_{i+2,j+1}$ | $G_{i+2,j+1}$ | $B_{i+2,j+1}$ | $R_{i+2,j+2}$ | $G_{i+2,j+2}$ | $B_{i+2,j+2}$ | $R_{i+2,j+3}$ | $G_{i+2,j+3}$ | $B_{i+2,j+3}$ | ··· |
| $R_{i+3,j}$ | $G_{i+3,j}$ | $B_{i+3,j}$ | $R_{i+3,j+1}$ | $G_{i+3,j+1}$ | $B_{i+3,j+1}$ | $R_{i+3,j+2}$ | $G_{i+3,j+2}$ | $B_{i+3,j+2}$ | $R_{i+3,j+3}$ | $G_{i+3,j+3}$ | $B_{i+3,j+3}$ | ··· |
| ··· | ··· | ··· | ··· | ··· | ··· | ··· | ··· | ··· | ··· | ··· | ··· | ··· |

FIG. 4

| | | | | | | |
|---|---|---|---|---|---|---|
| $R_{i,j}$ | $G_{i,j}$ | $B_{i,j}$ | $R_{i,j+2}$ | $G_{i,j+2}$ | $B_{i,j+2}$ | ····· |
| $R_{i+2,j}$ | $G_{i+2,j}$ | $B_{i+2,j}$ | $R_{i+2,j+2}$ | $G_{i+2,j+2}$ | $B_{i+2,j+2}$ | ····· |
| ····· | ····· | ····· | ····· | ····· | ····· | ····· |

FIG. 5

| | | | | | | | | | | | | |
|---|---|---|---|---|---|---|---|---|---|---|---|---|
| $PR_{i,j}$ | $PG_{i,j}$ | $PB_{i,j}$ | $PR_{i,j}$ | $PG_{i,j}$ | $PB_{i,j}$ | $PR_{i,j+2}$ | $PG_{i,j+2}$ | $PB_{i,j+2}$ | $PR_{i,j+2}$ | $PG_{i,j+2}$ | $PB_{i,j+2}$ | ... |
| $PR_{i,j}$ | $PG_{i,j}$ | $PB_{i,j}$ | $PR_{i,j}$ | $PG_{i,j}$ | $PB_{i,j}$ | $PR_{i,j+2}$ | $PG_{i,j+2}$ | $PB_{i,j+2}$ | $PR_{i,j+2}$ | $PG_{i,j+2}$ | $PB_{i,j+2}$ | ... |
| $PR_{i+2,j}$ | $PG_{i+2,j}$ | $PB_{i+2,j}$ | $PR_{i+2,j}$ | $PG_{i+2,j}$ | $PB_{i+2,j}$ | $PR_{i+2,j+2}$ | $PG_{j+2,j+2}$ | $PB_{i+2,j+2}$ | $PR_{i+2,j+2}$ | $PG_{i+2,j+2}$ | $PB_{i+2,j+2}$ | ... |
| $PR_{i+2,j}$ | $PG_{i+2,j}$ | $PB_{i+2,j}$ | $PR_{i+2,j}$ | $PG_{i+2,j}$ | $PB_{i+2,j}$ | $PR_{i+2,j+2}$ | $PG_{j+2,j+2}$ | $PB_{i+2,j+2}$ | $PR_{i+2,j+2}$ | $PG_{i+2,j+2}$ | $PB_{i+2,j+2}$ | ... |
| ... | ... | ... | ... | ... | ... | ... | ... | ... | ... | ... | ... | ... |

FIG. 6

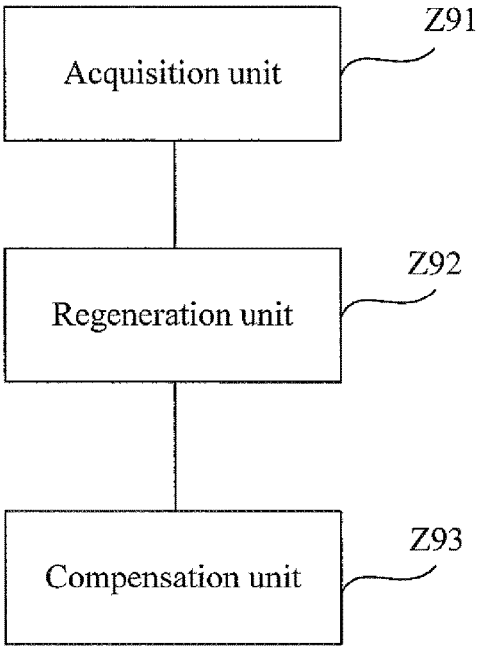

FIG. 7

LUMINANCE COMPENSATION METHOD OF DISPLAY DEVICE, LUMINANCE COMPENSATION DEVICE AND DISPLAY DEVICE

This application is a U.S. National Phase Entry of International Application No. PCT/CN2014/088689 filed on Oct. 15, 2014, designating the United States of America and claiming priority to Chinese Patent Application No. 201410240582.0 filed on May 30, 2014. The present application claims priority to and the benefit of the above-identified applications and the above-identified applications are incorporated by reference herein in their entirety.

TECHNICAL FIELD

Embodiments of the invention relate to a luminance compensation method of a display device, a luminance compensation device and a display device.

BACKGROUND

Under present technical conditions, an Organic Light Emitting Diode (OLED) display device has spatial and temporal non-uniformity, and as a size of the display device increases, such problems become more and more apparent, so how to solve the non-uniformity of display of the large-sized OLED display device becomes one of key technologies in mass production. The non-uniformity of display of the OLED display device is closely related with the manufacturing process; when threshold voltages of pixels of an entire display panel are quite different, overall luminance uniformity of the display device will be deteriorated. Moreover, organic material is accompanied with the problem of luminance changing in its service life. Hence, various compensation methods are needed to improve the non-uniformity of display.

The compensation method can be divided into two categories: internal compensation and external compensation. The internal compensation refers to a method for compensating using a sub-circuit constructed by a Thin Film Transistor (TFT) inside a pixel; the external compensation refers to a compensating method in which a TFT or OLED signal is extracted out of the display panel, and then by using an outside Application Specific Integrated Circuit (ASIC) outside, the compensating is performed. Generally, both the pixel structure and driving mode of the internal compensation are relatively complex; and in display applications of large size, high resolution and high refresh rate, the internal compensation method may cause a decreased aperture ratio and a slow driving speed; while the external compensation has a simple pixel structure, a faster driving speed and a better compensation effect.

The external compensation can be further divided into an optical extraction mode and an electrical extraction mode depending on different data extraction methods. The optical extraction mode refers to extracting a luminance signal by an image sensor, for example, photographing of a Charge Coupled Device (CCD), after the display panel is lightened; and the electrical extraction mode refers to extracting an electrical signal of the TFT and the OLED by a sensing circuit of a driving chip. Since the signals extracted by the two methods are different in type, data processing methods are also different. Now it is required that, when the luminance compensation is performed for a display device, high-quality luminance compensation effect is achieved while the hardware cost is reduced.

SUMMARY OF THE INVENTION

Embodiments of the present invention provide a luminance compensation method of a display device, a luminance compensation device and a display device, for reducing a stored data amount of compensation information in a process of improving luminance uniformity of the display device, thereby reducing the hardware cost.

In one aspect, an embodiment of the present invention provides a luminance compensation method of a display device, comprising: acquiring a preset first luminance compensation information list of the display device, the first luminance compensation information list comprising initial luminance compensation information of a part of a plurality of pixels of the display device; regenerating target luminance compensation information of all of the plurality of pixels of the display device according to the first luminance compensation information list; performing luminance compensation for an input image according to the target luminance compensation information of all of the plurality of pixels of the display device, wherein the part of the plurality of pixels are dispersedly taken from all of the plurality of pixels of the display device.

In another aspect, an embodiment of the present invention provides a luminance compensation device of a display device, comprising: an acquisition unit, configured to: acquire a preset first luminance compensation information list of the display device, the first luminance compensation information list including initial luminance compensation information of a part of a plurality of pixels of the display device; a regeneration unit, configured to: regenerate target luminance compensation information of all of the plurality of pixels of the display device according to the first luminance compensation information list; a compensation unit, configured to: perform luminance compensation for an input image according to the target luminance compensation information of all of the plurality of pixels of the display device, wherein the part of the plurality of pixels are dispersedly taken from all of the plurality of pixels of the display device.

In still another aspect, an embodiment of the present invention further provides a display device, the display device comprising the luminance compensation device described above.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

FIG. 3 is a schematic diagram of an exemplary arrangement of sub-pixels of a display device;

FIG. 4 is a schematic diagram of a pixel array of a display device;

FIG. 5 is a schematic diagram of a pixel array constructed by an exemplary method of selecting a part of pixels provided by an embodiment of the present invention;

FIG. 6 is a schematic diagram of a list of target luminance compensation information of all pixels exemplarily regenerated provided by an embodiment of the present invention;

FIG. 7 is a structural schematic diagram of a luminance compensation device of a display device provided by an embodiment of the present invention.

DESCRIPTION OF THE EMBODIMENTS

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Embodiments of the present invention provide a luminance compensation method of a display device, a luminance compensation device and a display device, for reducing the amount of stored data of compensation information while improving luminance uniformity of the display device, thereby reducing the hardware cost.

Figure 1:
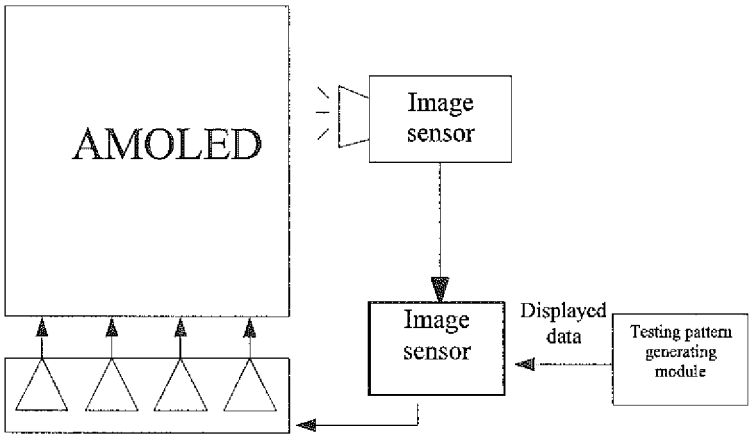
FIG. 1 is a schematic diagram of an exemplary external optical compensation solution.
Figure 2:
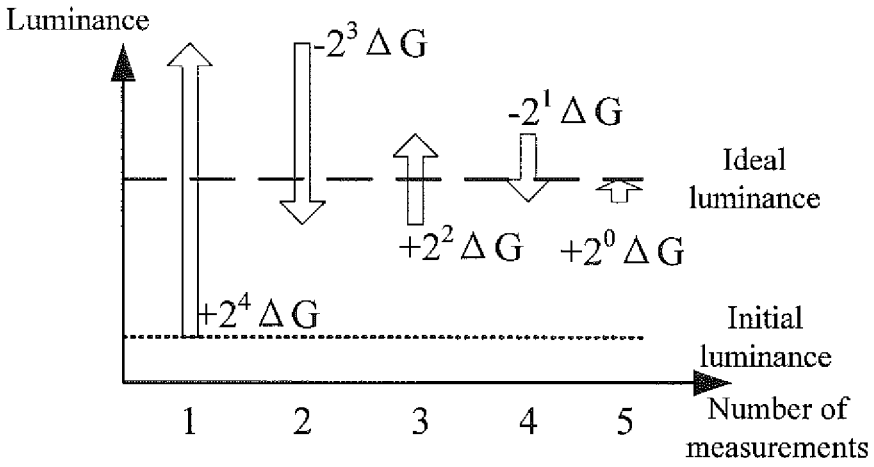
FIG. 2 is a schematic diagram of a calculating method of an exemplary external optical compensation.

FIG. 1 is a schematic diagram of a principle of an exemplary external optical compensation solution, and an image sensor is typically a CCD camera. The method is to compare a luminance value acquired by photographing with an ideal value, and then select an appropriate grayscale offset $\Delta G$; to proceed in a successive approximation manner, as shown in FIG. 2. A compensation accuracy of this method depends on a magnitude of $\Delta G$, and a compensation range is $(2^n-1)\Delta G$ where n is the number of measurements. For each pixel of the display device, such compensation information can be acquired, and all the compensation information are stored in a memory of the display device; when the display device works normally, the compensation information are read from the memory to perform luminance compensation for the display device. However, when the data amount of compensation information to be stored in the memory is too large, a storage space of the memory and a bandwidth to transmit the compensation information will become limitative conditions, whereas if the storage space of the memory or the bandwidth to transmit such compensation information is increased, production costs will be increased. Therefore, when the luminance compensation is performed for the display device, it is necessary to achieve high-quality luminance compensation while reducing the hardware cost.

Hereinafter, the technical solution of an embodiment of the present invention will be described in a clearly and fully understandable way in connection with the drawing related to the embodiment of the invention. It is obvious that the described embodiments are just a part but not all of the embodiments of the invention. Based on the described embodiments herein, those skilled in the art can obtain other embodiment(s), without any inventive work, which should be within the scope of the embodiments of the present invention.

Generally, a display device includes i rows and j columns of pixels, and then the display device includes i×j pixels; it is assumed that each pixel includes three sub-pixels: a red pixel R, a green pixel G and a blue pixel B, then the display device includes i×j×3 sub-pixels. For example, as shown in FIG. 3, for a display device of 5 rows and 5 columns, the display device includes 5×15 sub-pixels. When the luminance compensation is performed for an input image of the display device, the luminance compensation is performed for the display device in a unit of each sub-pixel.

Hereinafter, a luminance compensation method of a display device provided by an embodiment of the present invention will be described.

An embodiment of the present invention provides a luminance compensation method of a display device, comprising:

Acquiring a preset first luminance compensation information list of the display device, the first luminance compensation information list including initial luminance compensation information of a part of pixels of the display device;

Regenerating target luminance compensation information of all of the pixels of the display device according to the first luminance compensation information list;

Performing luminance compensation for an input image according to the target luminance compensation information of the all of the pixels of the display device;

Wherein the part of the pixels are dispersedly taken from the all of the pixels of the display device.

Exemplarily, for each of the pixels of the display device, the initial luminance compensation information is determined according to a testing luminance value and a target luminance value of the pixel under a testing pattern. Moreover, exemplarily, the testing luminance value is acquired by an image sensor, and the target luminance value may be preset or may be an average value obtained according to the testing luminance values.

In the above-described luminance compensation method provided by the embodiment of the present invention, a first luminance compensation information list of the display device is preset, wherein the first luminance compensation information list includes the initial luminance compensation information of a part of pixels of the display device, and the first luminance compensation information list is stored. When the display device works normally, the preset first luminance compensation information list of the display device is acquired, so that the data amount of the first luminance compensation information list is significantly less than the data amount of the initial luminance compensation information of all of the pixels, resulting in a lowered demand on storage space and transmission bandwidth, and further reducing the hardware cost; and further, the target luminance compensation information of all of the pixels of the display device are regenerated according to the first luminance compensation information list, and then the luminance compensation is performed for the input image according to the target luminance compensation information of all of the pixels of the display device, so high-quality luminance compensation is achieved for each pixel.

Exemplarily, presetting the first luminance compensation information list, includes: selecting the initial luminance compensation information of a part of the pixels from all of the pixels of the display device to generate the first luminance compensation information list.

Exemplarily, the selecting the initial luminance compensation information of a part of the pixels from all of the pixels of the display device to generate the first luminance compensation information list, includes: selecting initial luminance compensation information of a pixel located on a crossing position of an odd-numbered row and an odd-numbered column from all of the pixels of the display device to generate the first luminance compensation information list; or, selecting initial luminance compensation information of a pixel located on a crossing position of an odd-numbered row and an even-numbered column to generate the first luminance compensation information list; or, selecting initial luminance compensation information of a pixel located on a crossing position of an even-numbered row and an odd-numbered column to generate the first luminance compensation information list; or, selecting initial luminance compensation information of a pixel located on a crossing position of an even-numbered row and an even-numbered column to generate the first luminance compensation information list.

In an existing display device, there is a small difference between the initial luminance compensation information of adjacent pixels of the display device, so, with the selection method described above, a small difference between selected initial luminance compensation information and discarded initial luminance compensation information is maximally ensured, and a uniform distribution of the selected initial luminance compensation information can be guaranteed, which is conducive to a follow-up regeneration of the target luminance compensation information of all of the pixels according to the first luminance compensation information list.

Of course, the generating the first luminance compensation information list according to the initial luminance compensation information is not limited to the above method, for example, the initial luminance compensation information may be divided into a plurality of regions, in each region, the initial luminance compensation information of one pixel may be selected, and then the first luminance compensation information list can be generated by all of the selected initial luminance compensation information of the plurality of regions.

Exemplarily, in the process of setting the first luminance compensation information list, the selecting the initial luminance compensation information of a part of the pixels, may include modes of:

Mode I: when the testing luminance value of the pixel is acquired, only the testing luminance values of a part of the pixels are acquired; and further, for these selected pixels, for each selected pixel, the initial luminance compensation information of the pixel may be determined according to the testing luminance value and the target luminance value under a testing pattern, that is, the above selection process occurs at an acquisition phase of the testing luminance value of the pixel;

Mode II: the testing luminance values of all of the pixels are acquired, and for each pixel, the initial luminance compensation information of the pixel may be determined according to the testing luminance value and the target luminance value under the testing pattern; further, when the first luminance compensation information list is formed, only the initial luminance compensation information of a part of the pixels are selected to form the first luminance compensation information list, that is, the above selection process occurs at a generating phase of the first luminance compensation information list.

Exemplarily, the regenerating target luminance compensation information of all of the pixels of the display device according to the first luminance compensation information list, includes:

Taking the initial luminance compensation information of each pixel in the first luminance compensation information list as target luminance compensation information of the pixel and target luminance compensation information of a pixel adjacent to the pixel. For example, the target luminance compensation information of the pixel is selected as the target luminance compensation information of its adjacent pixel on the right, the target luminance compensation information of its adjacent pixel below, and the target luminance compensation information of its adjacent pixel on the lower right.

Of course, the regenerating target luminance compensation information of all of the pixels of the display device according to the first luminance compensation information list is not limited to the above method, as long as it can guarantee that: for each pixel, the smaller the difference between the regenerated target luminance compensation information and the initial luminance compensation information of the pixel, the better.

Exemplarily, the acquiring the first luminance compensation information list, includes:

Acquiring the preset first luminance compensation information list of the display device from a volatile memory of the display device.

As data is read from the volatile memory at a fast speed, when the display device displays an image in real time, the luminance compensation can be quickly performed for each sub-pixel of an input image.

Exemplarily, the acquiring the first luminance compensation information list, further includes:

Reading the first luminance compensation information list from a non-volatile memory of the display device to the volatile memory, before the acquiring the first luminance compensation information list from the volatile memory of the display device.

Since a data is only retained in the volatile memory for a short time, by saving the first luminance compensation information list into the non-volatile memory, the life of stored data can be guaranteed; meanwhile, when the display device works nomially, the first luminance compensation information list is read from the non-volatile memory to the volatile memory, and the first luminance compensation information list is acquired from the volatile memory in real time, thereby guaranteeing an efficiency of real-time compensation.

Hereinafter, a luminance compensation method of a display device provided by an embodiment of the present invention will be described in connection with drawings.

In the luminance compensation method of the display device provided by the embodiment of the present invention, the first luminance compensation list needs to be preset. Exemplarily, a process of setting the first luminance compensation information list should be completed before the display device leaves factory.

Exemplarily, the process of presetting the first luminance compensation information list is described at first.

Hereinafter, a case of acquiring testing luminance values of a part of the pixels upon acquiring testing luminance values is taken as an example for description. Exemplarily, the presetting the first luminance compensation information list, includes:

Step S401: selecting a part of pixels whose testing luminance value are to be acquired, from among all of the pixels of the display device;

Step S402: for each of the part of the pixels selected, determining initial luminance compensation information of the pixel according to testing luminance value and target luminance value of the pixel under a testing pattern;

Step S403: forming the first luminance compensation information list by the initial luminance compensation information of the selected pixels.

Exemplarily, for a pixel including three sub-pixels R, G, and B, the initial luminance compensation information of each pixel include initial luminance compensation information of the sub-pixel R, initial luminance compensation information of the sub-pixel G and initial luminance compensation information of the sub-pixel B.

In step S401, the pixel arrangement of the display device is, for example, shown in FIG. 4, wherein, $R_{ij}$ is a sub-pixel R of a pixel located on an i-th row and a j-th column, is a sub-pixel $G_{ij}$ of the pixel located on the i-th row and the j-th column, and $B_{ij}$ is a sub-pixel B of the pixel located on the i-th row and the j-th column; in the pixel array shown in FIG. 4, the selecting a part of the pixels whose testing luminance value are to be acquired:

Selecting all of the pixels located on crossing positions of odd-numbered rows and odd-numbered columns; or, selecting all of the pixels located on crossing positions of odd-numbered rows and even-numbered columns; or, selecting all of the pixels located on crossing positions of even-numbered rows and odd-numbered columns; or, selecting all of the pixels located on crossing positions of even-numbered rows and even-numbered columns.

For example, upon selecting all of the pixels located on the crossing positions of odd-numbered rows and odd-numbered columns, the formed list is shown in FIG. 5, that is, it is to select the pixel of the first row and the first column, the pixel of the third row and the first column, the pixel of the first row and the third column, the pixel of the third row and the third column, and the pixel of the i-th row and the j-th column, the pixel of the (i+2)-th row and the j-th column, the pixel of the i-th row and the (j+2)-th column, the pixel of the (i+2)-th row and the (j+2)-th column, where i and j are odd values.

In step S402, in the determining the initial luminance compensation information of the pixel according to the testing luminance value and the target luminance value of the pixel under the testing pattern, the testing pattern may be determined according to a testing grayscale value, the measured testing luminance value is compared with the target luminance value, and then an appropriate grayscale offset $\Delta G$ is selected, to proceed in a successive approximation manner, as shown in FIG. 2, so each initial luminance compensation information is a grayscale variation. Of course, the initial luminance compensation information may also be determined by using other methods; meanwhile, the initial luminance compensation information is not limited to the grayscale variation or a luminance compensation factor. In other words, whichever method may be adopted as long as the initial luminance compensation information can be determined.

Step S403: generating the first luminance compensation information list by the initial luminance compensation information of the selected pixels.

After the first luminance compensation information list is preset, the first luminance compensation information list is stored in a memory of the display device. Exemplarily, since the non-volatile memory can save data for a long time, and the volatile memory can read data at a fast speed, when the first luminance compensation information list is saved in the memory of the display device, the first luminance compensation information list is actually saved in the non-volatile memory of the display device.

For a display device including i*j pixels, if the initial luminance compensation information of all of the pixels are stored, a data size of the compensation information is i*j*3*n bits, where n represents a bit-width of the initial luminance compensation information of each sub-pixel. Taking a resolution of 3840*2160 as an example, the data size of the compensation information is 3840*2160*3*n bits, and the size of these data decides capacities of the non-volatile memory and the volatile memory; it is assumed that the bit-width of the initial luminance compensation information of each sub-pixel is 16 bits, the data size of these compensation information is nearly 400M bits, which means that the capacities of both the non-volatile memory and the volatile memory should be greater than 400M bits to meet requirements, and when real-time compensation is preformed, requirements on data bandwidth of control components are higher, too. As a consumer electronic product, the display device is sensitive to cost, so in mass production, in order to reduce the hardware cost, it is critical to reduce the data size of the compensation information. In the luminance compensation method of the display device provided by the embodiment of the present invention, a resolution of 3840*2160 is also taken as an example, and the data size of the first luminance compensation information list is only 3840*2160*3*n/4, which thus greatly reduces the requirements on the capacities of the volatile memory and the non-volatile memory and on the transmission bandwidth, thereby reducing the hardware cost in the manufacturing process.

When the display device works normally, the first luminance compensation information list will be firstly read from the non-volatile memory to the volatile memory, and the first luminance compensation information list is acquired from the volatile memory in real time, so that the luminance compensation can be performed in real time, thereby improving the luminance uniformity of the display device.

Exemplarily, when the display device works normally, the luminance compensation method of the display device is shown as follows:

Step S701: acquiring a preset first luminance compensation information list of the display device, the first luminance compensation information list including initial luminance compensation information of a part of pixels of the display device, wherein the part of the pixels are dispersedly taken from all of the pixels of the display device.

Step S702: regenerating target luminance compensation information of all of the pixels of the display device according to the first luminance compensation information list;

Step S703: performing luminance compensation for an input image according to the target luminance compensation information of all of the pixels of the display device.

Exemplarily, in step S701, the preset first luminance compensation information list of the display device is read from the non-volatile memory to the volatile memory, and then the first luminance compensation information list is acquired from the volatile memory in real time.

In step S702, exemplarily, available modes are as follows:

Taking the initial luminance compensation information of one of the pixels in the first luminance compensation information list as target luminance compensation information of the pixel and target luminance compensation information of three pixels adjacent to the pixel.

Taking the pixels shown in FIG. 5 being pixels in the preset first luminance compensation information list as an example, in step S702, the initial luminance compensation information of the pixel in the first row and the first column serves as target luminance compensation information of the pixel in the first row and the first column, and target luminance compensation information of the pixel in the second row and the first column, target luminance compensation information of the pixel in the first row and the second column and target luminance compensation information of the pixel in the second row and the second column; the initial luminance compensation information of the pixel in an i-th row and a j-th column serves as target luminance compensation information of the pixel in the i-th row and the j-th column, and target luminance compensation information of the pixel in the (i+1)-th row and the j-th column, target luminance compensation information of the pixel in the i-th row and the (j+1)-th column, and target luminance compensation information of the pixel in the (i+1)-th row and the (j+1)-th column, where i and j are odd values; more intuitively, a list of the target luminance compensation information of all pixels of the display device is regenerated according to the first luminance compensation information list, as shown in FIG. 6, wherein $PR_{i,j}$ is initial luminance compensation information of the sub-pixel R of the pixel in the i-th row and the j-th column, $PG_{i,j}$ is initial luminance compensation information of the sub-pixel G of the pixel in the i-th row and the j-th column, and $PB_{i,j}$ is initial luminance compensation information of the sub-pixel B of the pixel in the i-th row and the j-th column.

In step S703, the luminance compensation is performed for an input image according to the target luminance compensation information of all pixels of the display device. A technology known by the inventor is adopted in this step, which will not be repeated here.

In the luminance compensation method provided by embodiments of the present invention, a first luminance compensation information list is preset, wherein the first luminance compensation information list includes the initial luminance compensation information of a part of pixels of the display device, and then the first luminance compensation information list is stored; when the display works normally, the preset first luminance compensation information list of the display device is acquired, so that the data amount of the first luminance compensation information list is significantly less than the data amount of the initial luminance compensation information of all of the pixels, resulting in a lowered demand on storage space and transmission bandwidth, and further reducing the hardware cost; and further, the target luminance compensation information of all of the pixels of the display device are regenerated according to the first luminance compensation information list, and then the luminance compensation is performed for an input image according to the target luminance compensation information of all of the pixels of the display device, so high-quality luminance compensation is achieved for each pixel.

The luminance compensation method of the display device provided by embodiments of the present invention is described in detail hereinbefore, and then a luminance compensation device of a display device provided by an embodiment of the present invention will be described in detail in connection with the drawings.

As shown in FIG. 7, a luminance compensation device of a display device provided by an embodiment of the present invention comprises:

An acquisition unit Z91, configured to: acquire a preset first luminance compensation information list of the display device, wherein the first luminance compensation information list includes initial luminance compensation information of a part of pixels of the display device, and the part of the pixels are dispersedly taken from all of the pixels of the display device;

A regeneration unit Z92, configured to: regenerate target luminance compensation information of all of the pixels of the display device according to the first luminance compensation information list;

A compensation unit Z93, configured to: perform luminance compensation for an input image according to the target luminance compensation information of all of the pixels of the display device.

Therein, Herein, for each of the pixels of the display device, the initial luminance compensation information is determined according to a testing luminance value and a target luminance value of the pixel under a testing pattern.

Exemplarily, the above luminance compensation device provided by the embodiment of the present invention may be a control module of the display device. Therein, the acquisition unit, the regeneration unit and the compensation unit may be implemented by, for example, a processor.

The above luminance compensation device provided by an embodiment of the present invention, by presetting a first luminance compensation information list of the display device, the first luminance compensation information list including initial luminance compensation information of a part of pixels of the display device, and by storing the first luminance compensation information list, when the display works normally, acquires the preset first luminance compensation information list of the display device, so that the data amount of the first luminance compensation information list is significantly less than the data amount of the initial luminance compensation information of all of the pixels, resulting in a lowered demand on storage space and transmission bandwidth, and further reducing the hardware cost; and further, the target luminance compensation information of all of the pixels of the display device are regenerated according to the first luminance compensation information list, and then the luminance compensation is performed for the input image according to the target luminance compensation information of all of the pixels of the display device, so high-quality luminance compensation is achieved for each pixel.

Exemplarily, the luminance compensation device further comprises:

A preset unit, configured to: from all of the pixels of the display device, select the initial luminance compensation information of a part of the pixels to generate the first luminance compensation information list.

Exemplarily, the preset unit is configured to: select initial luminance compensation information of a pixel located on a crossing position of an odd-numbered row and an odd-numbered column to generate the first luminance compensation information list; or, select initial luminance compensation information of a pixel located on a crossing position of an odd-numbered row and an even-numbered column to generate the first luminance compensation information list; or, select initial luminance compensation information of a pixel located on a crossing position of an even-numbered row and an odd-numbered column to generate the first luminance compensation information list; or, select initial luminance compensation information of a pixel located on a crossing position of an even-numbered row and an even-numbered column to generate the first luminance compensation information list.

In an existing display device, there is a small difference between the initial luminance compensation information of adjacent pixels of the display device, so, with the selection method described above, a small difference between selected initial luminance compensation information and discarded initial luminance compensation information is maximally ensured, and a uniform distribution of the selected initial luminance compensation information can be guaranteed, which is conducive to a follow-up regeneration of the target luminance compensation information of all of the pixels according to the first luminance compensation information list.

It should be noted that, the preset unit may be arranged inside the display device or independently arranged outside the display device. Exemplarily, the preset unit is a data processor independent of the display device.

Exemplarily, the regeneration unit is configured to:

Take the initial luminance compensation information of each of pixels in the first luminance compensation information list as target luminance compensation information of the pixel and target luminance compensation information of a pixel adjacent to the pixel. For example, the target luminance compensation information of the pixel is selected as target luminance compensation information of its adjacent pixel on the right, target luminance compensation information of its adjacent pixel below, and target luminance compensation information of its adjacent pixel on lower right.

Exemplarily, the acquisition unit is configured to:

Acquire the first luminance compensation information list from a volatile memory of the display device. As data is read from the volatile memory at a fast speed, when the display device displays an image in real time, the luminance compensation can be quickly performed for each sub-pixel of the input image.

Exemplarily, the acquisition unit is further configured to:

Read the first luminance compensation information list from a non-volatile memory of the display device to the volatile memory, before acquiring the first luminance compensation information list from the volatile memory of the display device.

Herein, both the non-volatile memory and the volatile memory may be disposed in the luminance compensation device, for example, both of them are disposed in the control module of the display device.

Since a data is only retained in the volatile memory for a short time, by saving the first luminance compensation information list into the non-volatile memory, the life of stored data can be guaranteed; meanwhile, when the display device works normally, the first luminance compensation information list is read from the non-volatile memory to the volatile memory, and the first luminance compensation information list is acquired from the volatile memory in real time, thereby guaranteeing an efficiency of real-time compensation.

An embodiment of the present invention further provides a display device, and the display device comprises the above-described luminance compensation device. The display device may be: a liquid crystal panel, E-paper, an OLED panel, a mobile phone, a tablet computer, a television, a display, a notebook computer, a digital photo frame, a navigator, or any other product or component having a display function.

Hereinafter, the luminance compensation device provided by the embodiment of the present invention will be described in connection with drawings.

Hereinafter, it will be illustrated by taking the preset unit being a data processor independent of the display device, while the luminance compensation device being a control module of the display device as an example.

Figure 8:
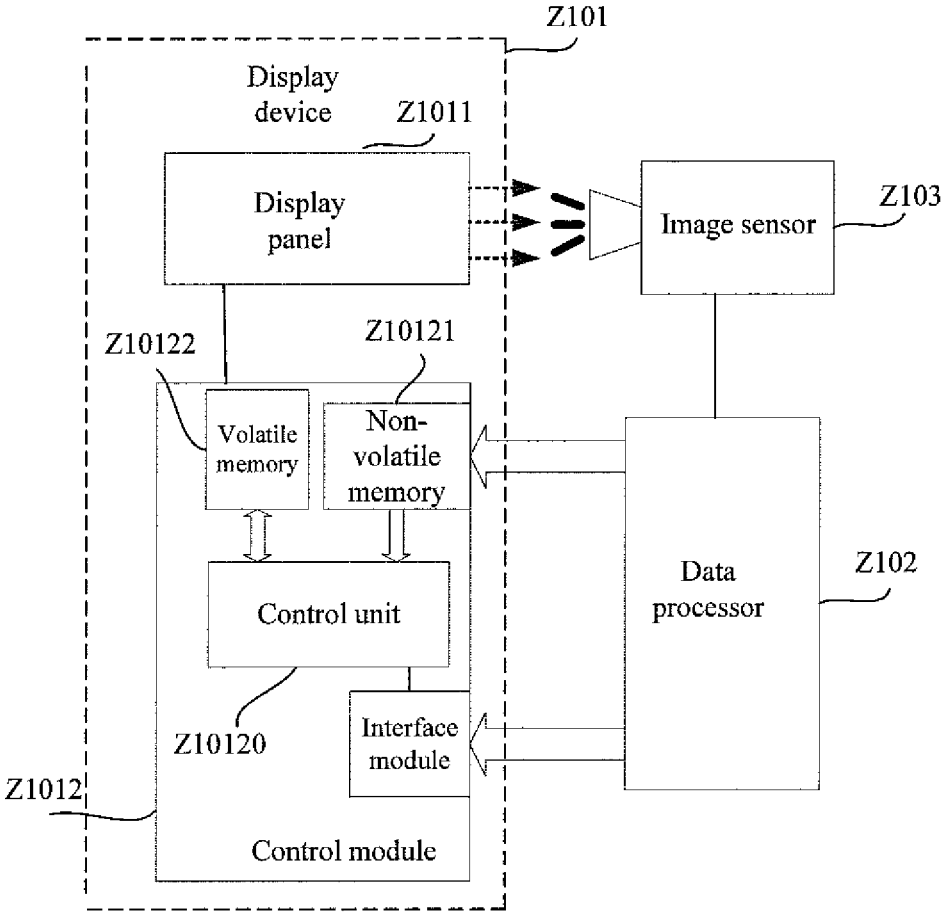
FIG. 8 is a block diagram of a display device comprising a luminance compensation device provided by an embodiment of the present invention.

As shown in FIG. 8, when the luminance compensation is performing for a display device Z101, a testing pattern needs to be generated by a data processor Z102, and a testing luminance value of a pixel under the testing pattern is acquired by an image sensor Z103.

Herein, the display device Z101 includes a display panel Z1011 and a control module Z1012 for controlling the display panel to display.

Exemplarily, the control module Z1012 includes: a control unit Z10120, a non-volatile memory Z10121, a non-volatile memory Z10122 and an interface module.

Exemplarily, the control unit Z10120 includes:

An acquisition unit, configured to: acquire a preset first luminance compensation information list of the display device, which includes the initial luminance compensation information of a part of pixels of the display device, and the part of the pixels is dispersedly taken from all of the pixels of the display device. Exemplarily, the acquisition unit can read the first luminance compensation information list from the non-volatile memory to the volatile memory, and further acquire the first luminance compensation information list from the volatile memory in real time.

A regeneration unit, configured to: regenerate target luminance compensation information of all of the pixels of the display device according to the first luminance compensation information list. Exemplarily, the initial luminance compensation information of each of the pixels in the first luminance compensation information list serves as target luminance compensation information of the pixel and target luminance compensation information of a pixel adjacent to the pixel; for example, the target luminance compensation information of the pixel is selected as target luminance compensation information of its adjacent pixel on the right, target luminance compensation information of its adjacent pixel below, and target luminance compensation information of its adjacent pixel on the lower right.

A compensation unit, configured to: perform luminance compensation for an input image according to the target luminance compensation information of all of the pixels of the display device.

The non-volatile memory Z10121 and the volatile memory Z10122 are used to store the first luminance compensation information list; the non-volatile memory Z10121 is used to store the first luminance compensation information list sent by the data processor Z102; the volatile memory Z10122 is used to store the first luminance compensation information list read from the non-volatile memory Z10121 by the control unit.

An interface module, for receiving an input testing pattern at a testing phase, and for receiving an input image when the display works normally. This module adopts a technology known by the inventor, which will not be repeated here.

The display panel Z1011 may be an AMOLED, or a liquid crystal display panel, which is not limited here.

The data processor Z102 is for presetting the first luminance compensation information list, exemplarily, in a pixel array of the display device, selecting initial luminance compensation information of a pixel located on a crossing position of an odd-numbered row and an odd-numbered column to generate the first luminance compensation information list; or, selecting initial luminance compensation information of a pixel located on a crossing position of an odd-numbered row and an even-numbered column to generate the first luminance compensation information list; or, selecting initial luminance compensation information of a pixel located on a crossing position of an even-numbered row and an odd-numbered column to generate the first luminance compensation information list; or, selecting initial luminance compensation information of a pixel located on a crossing position of an even-numbered row and an even-numbered column to generate the first luminance compensation information list.

To sum up, as for the luminance compensation method, the luminance compensation device and the display device provided by embodiments of the present invention, by presetting a first luminance compensation information list of the display device, wherein the first luminance compensation information list includes initial luminance compensation information of a part of pixels of the display device, the first luminance compensation information list is stored; when the display works normally, the preset first luminance compensation information list of the display device is acquired, so that the data amount of the first luminance compensation information list is significantly less than the data amount of the initial luminance compensation information of all of the pixels, resulting in a lowered demand on storage space and transmission bandwidth, and further reducing the hardware cost; and further, the target luminance compensation information of all pixels of the display device are regenerated according to the first luminance compensation information list, and then the luminance compensation is performed for an input image according to the target luminance compensation information of all pixels of the display device, so high-quality luminance compensation is achieved for each pixel.

Embodiments of the present invention are described herein with reference to exemplary methods, apparatuses (systems), and flowcharts and/or block diagrams of computer program products. It should be understood that each flow and/or block in the flowchart and/or block diagram, and a combination of flow and/or block in the flowchart and/or block diagram can be implemented by computer program instructions. These computer program instructions may be provided to a general-purpose computer, a special-purpose computer, an embedded processor or a processor of other programmable data processing apparatus to form a machine, such that devices for implementing functions specified by one or more flows in a flowchart and/or one or more blocks in a block diagram may be generated by executing the instructions with the processor of the computer or other programmable data processing apparatus.

These computer program instructions may also be stored in a computer-readable memory that can direct a computer or other programmable data processing apparatus to function in a particular manner, such that the instructions stored in the computer-readable memory produce a manufactured article including an instruction device, the instruction device implementing the functions specified by one or more flows in a flowchart and/or one or more blocks in a block diagram.

These computer program instructions may also be loaded onto a computer or other programmable data processing apparatus, such that a series of process steps may be executed on the computer or other programmable data processing apparatus to produce a process implemented by the computer, and thereby, the instructions executed on the computer or other programmable data processing apparatus provide steps of the functions specified by one or more flows in a flowchart and/or one or more blocks in a block diagram.

It is evident that one person skilled in the art can make various changes or modifications to the present invention without departing from the spirit and scope of the invention. Thus, if these changes and modifications to the present invention are within the scope of the claims of the present invention and equivalents, the present invention also intends to include all such changes and modifications within its scope.

The present application claims priority of Chinese Patent Application No. 201410240582.0 filed on May 30, 2014, the disclosure of which is incorporated herein by reference in its entirety as part of the present application.

What is claimed is:

1. A luminance compensation method of a display device, comprising:

acquiring a preset first luminance compensation information list of the display device, the first luminance compensation information list comprising initial luminance compensation information of a part of a plurality of pixels of the display device, wherein for each pixel of the part of the plurality of pixels of the display device, the initial luminance compensation information is determined according to a luminance difference between a testing luminance value and a target luminance value of the pixel under a testing pattern, wherein each pixel comprises multiple sub-pixels;

generating target luminance compensation information of all of the plurality of pixels of the display device according to the first luminance compensation information list; and performing luminance compensation for an input image according to the target luminance compensation information of all of the plurality of pixels of the display device, wherein the part of the plurality of pixels are dispersedly taken from all of the plurality of pixels of the display device, and wherein the generating the target luminance compensation information of all of the plurality of pixels of the display device according to the first luminance compensation information list comprises:

taking initial luminance compensation information of each pixel in the first luminance compensation information list as target luminance compensation information of a corresponding pixel and target luminance compensation information of an adjacent pixel that is adjacent to the corresponding pixel, wherein the initial luminance compensation information of the corresponding pixel includes initial compensation values for multiple sub-pixels of the corresponding pixel, the target luminance compensation information of the corresponding pixel includes target compensation values for the multiple sub-pixels of the corresponding pixel, the target luminance compensation information of the adjacent pixel includes target compensation values for multiple sub-pixels of the adjacent pixel, and the target compensation values for the multiple sub-pixels of the corresponding pixel are identical to the initial compensation values for the multiple sub-pixels of the corresponding pixel and identical to the target compensation values for the multiple sub-pixels of the adjacent pixel, wherein the acquiring the preset first luminance compensation information list comprises selecting the initial luminance compensation information of the part of the plurality of pixels of the display device to generate the first luminance compensation information list, which compromises:

selecting initial luminance compensation information of all pixels located on a crossing position of an odd-numbered row and an odd-numbered column from all of the plurality of pixels of the display device to generate the first luminance compensation information list; or, selecting initial luminance compensation information of all pixels located on a crossing position of an odd-numbered row and an even-numbered column to generate the first luminance compensation information list; or, selecting initial luminance compensation information of all pixels located on a crossing position of an even-numbered row and an odd-numbered column to generate the first luminance compensation information list; or, selecting initial luminance compensation information of all pixels located on a crossing position of an even-numbered row and an even-numbered column to generate the first luminance compensation information list, wherein the taking the initial luminance compensation information of each pixel in the first luminance compensation information list as a target luminance compensation information of the corresponding pixel and target luminance compensation information of the adjacent pixel that is adjacent to the corresponding pixel compromises: taking the initial luminance compensation information of each pixel in the first luminance compensation information list as target luminance compensation information of the corresponding pixel, target luminance compensation information of an adjacent pixel on a right side of the corresponding pixel, the target luminance compensation information of an adjacent pixel below the corresponding pixel and the target luminance compensation information of an adjacent pixel on a lower right side of the corresponding pixel.

2. The luminance compensation method according to claim 1, wherein the acquiring the first luminance compensation information list comprises:

acquiring the first luminance compensation information list from a volatile memory of the display device.

3. The luminance compensation method according to claim 2, wherein the acquiring the first luminance compensation information list further comprises:

reading the first luminance compensation information list from a non-volatile memory of the display device to the volatile memory, before the acquiring the first luminance compensation information list from the volatile memory of the display device.

4. The luminance compensation method according to claim 1, wherein the selecting the initial luminance compensation information of the part of the plurality of pixels of the display device to generate the first luminance compensation information list comprises:

acquiring a testing luminance value of each pixel of the part of the plurality of pixels, and determining initial luminance compensation information of the pixel according to the testing luminance value and the target luminance value of the pixel to generate the first luminance compensation information list.

5. The luminance compensation method according to claim 1, wherein the selecting the initial luminance compensation information of the part of the plurality of pixels of the display device to generate the first luminance compensation information list comprises:

acquiring testing luminance values of all of the plurality of pixels of the display device;

determining initial luminance compensation information of each of all of the plurality of pixels according to testing luminance values and target luminance values of all of the plurality of pixels; and selecting the initial luminance compensation information of the part of the plurality of pixels to generate the first luminance compensation information list.

6. The luminance compensation method according to claim 1, wherein each initial compensation value and each target compensation value for a corresponding sub-pixel comprises a corresponding grayscale variation value for the corresponding sub-pixel.

7. A luminance compensation device of a display device, comprising:

an acquisition unit, configured to: acquire a preset first luminance compensation information list of the display device, the first luminance compensation information list compromising initial luminance compensation information of a part of a plurality of pixels of the display device, wherein for each pixel of the part of the plurality of pixels of the display device, the initial luminance compensation information is determined according to a luminance difference between a testing luminance value and a target luminance value of the pixel under a testing pattern, wherein each pixel comprises multiple sub-pixels;

a regeneration unit, configured to: generate target luminance compensation information of all of the plurality of pixels of the display device according to the first luminance compensation information list; and a compensation unit, configured to: perform luminance compensation for an input image according to the target luminance compensation information of all of the plurality of pixels of the display device, wherein the part of the plurality of pixels are dispersedly taken from all of the plurality of pixels of the display device, and wherein the regeneration unit is configured to take initial luminance compensation information of each pixel in the first luminance compensation information list as target luminance compensation information of a corresponding pixel and target luminance compensation information of an adjacent pixel that is adjacent to the corresponding pixel, wherein the initial luminance compensation information of the corresponding pixel includes initial compensation values for multiple sub-pixels of the corresponding pixel, the target luminance compensation information of the corresponding pixel includes target compensation values for the multiple sub-pixels of the corresponding pixel, and the target luminance compensation information of the adjacent pixel includes target compensation values for multiple sub-pixels of the adjacent pixel, and the target compensation values for the multiple sub-pixels of the corresponding pixel are identical to the initial compensation values for the multiple sub-pixels of the corresponding pixel and identical to the target compensation values for the multiple sub-pixels of the adjacent pixel, wherein the luminance compensation device compromises: a preset unit, configured to: select the initial luminance compensation information of the part of the plurality of pixels of the display device to generate the first luminance compensation information list, the preset unit is configured to: select initial luminance compensation information of a pixel located on a crossing position of an odd-numbered row and an odd-numbered column from all of the plurality of pixels of the display device to generate the first luminance compensation information list; or, select initial luminance compensation information of a pixel located on a crossing position of an odd-numbered row and an even-numbered column to generate the first luminance compensation information list; or, select initial luminance compensation information of a pixel located on a crossing position of an even-numbered row and an odd-numbered column to generate the first luminance compensation information list; or, select initial luminance compensation information of a pixel located on a crossing position of an even-numbered row and an even numbered column to generate the first luminance compensation information list, the regeneration unit is configured to take the initial luminance compensation information of each pixel in the first luminance compensation information list as target luminance compensation information of the corresponding pixel, target luminance compensation information of an adjacent pixel on a right side of the corresponding pixel, the target luminance compensation information of an adjacent pixel below the corresponding pixel, and the target luminance compensation information of an adjacent pixel on a lower right side of the corresponding pixel.

8. The luminance compensation device according to claim 7, wherein the acquisition unit is configured to:

acquire the first luminance compensation information list from a volatile memory of the display device.

9. The luminance compensation device according to claim 8, wherein the acquisition unit is configured to:

read the first luminance compensation information list from a non-volatile memory of the display device to the volatile memory, before acquiring the first luminance compensation information list from the volatile memory of the display device.

10. A display device, comprising a display panel and the luminance compensation device according to claim 7.

11. The luminance compensation method according to claim 1, wherein each initial compensation value and each target compensation value for a corresponding sub-pixel comprises a corresponding luminance compensation factor for the corresponding sub-pixel.

* * * * *